United States Patent [19]

Herrington

[11] Patent Number: 4,603,434

[45] Date of Patent: Jul. 29, 1986

[54] RIPPLE LOCK CLOSURE FOR FLEXIBLE BAGS

[75] Inventor: Fox J. Herrington, Holcomb, N.Y.

[73] Assignee: Mobil Oil Corporation, New York, N.Y.

[21] Appl. No.: 631,951

[22] Filed: Jul. 17, 1984

Related U.S. Application Data

[63] Continuation-in-part of Ser. No. 455,441, Jan. 3, 1983, abandoned.

[51] Int. Cl.[4] ..... B65D 33/24; A44B 17/00

[52] U.S. Cl. ..... 383/95; 383/42; 383/86; 24/30.5 R; 24/577

[58] Field of Search ..... 383/86, 95, 42, 81, 383/63, 71; 24/577, 578, 575, 449, 452, 30.5 R

[56] References Cited

U.S. PATENT DOCUMENTS

| | | | |
|---|---|---|---|
| Re. 28,969 | 9/1976 | Naito | 383/65 |
| 2,035,674 | 3/1936 | Sipe | 383/68 X |
| 2,823,720 | 2/1958 | Svec et al. | 383/65 |
| 3,060,985 | 10/1962 | Vance et al. | 383/68 |
| 3,226,787 | 1/1966 | Ausnit | 383/65 X |
| 3,325,084 | 6/1967 | Ausnit | 24/577 |
| 3,338,285 | 8/1967 | Jaster | 383/65 |
| 3,339,606 | 9/1967 | Kugler | 383/63 |
| 3,420,433 | 1/1969 | Bostwick | 383/86 X |
| 3,557,413 | 1/1971 | Engle | 24/575 |
| 3,632,029 | 1/1972 | Sonner | 383/95 X |
| 3,869,764 | 3/1975 | Tanaka et al. | 24/577 |
| 3,974,960 | 8/1976 | Mitchell | 383/71 X |
| 3,990,627 | 11/1976 | Olson | 383/95 X |
| 4,123,826 | 11/1978 | Tanaka | 24/577 |
| 4,186,786 | 2/1980 | Kirkpatrick | 383/63 |
| 4,443,400 | 4/1984 | Herrington | 264/519 |

FOREIGN PATENT DOCUMENTS 1523206 5/1968 France .

*Primary Examiner*—William Price
*Assistant Examiner*—Sue A. Weaver
*Attorney, Agent, or Firm*—Alexander J. McKillop; Michael G. Gilman; Charles J. Speciale

[57] ABSTRACT

A disposable plastic bag is provided having a closure formed by a plurality of ripple strips where each ripple strip comprises a band of rows of adjoining waves, the waves being shaped and positioned such that the highest amplitude of one row is adjacent to the lowest amplitude of the nearest rows. In one embodiment, the highest and lowest points of each row have flanges extending therefrom which interlock with the waves of a facing strip. In a second embodiment, the width of each row is regularly varied and the widest portions of each strip interlock with the widest portions of a similar facing strip.

12 Claims, 18 Drawing Figures

RIPPLE LOCK CLOSURE FOR FLEXIBLE BAGS

This application is a continuation-in-part of Ser. No. 455,441, filed Jan. 3, 1983, now abandoned.

BACKGROUND OF THE INVENTION

1. Field of the Invention

The present invention relates to a closure suitable for use with flexible bags and particularly disposable bags formed therewith. These bags include sandwich bags made out of polyethylene film as well as disposable trash and garbage bags made from the same and similar plastic materials. Related applications assigned to the same assignee as this application include the following co-pending applications: "Adhesive Channel Closure for Flexible Bags", Ser. No. 335,798; "Laminated Pressure Sensitive Adhesive Systems for Use in Plastic Bags", Ser. No. 335,799, U.S. Pat. No. 4,415,087 ; "Adhesive Bag Closure that Opens Easily by Hand But Resists Opening by Contents", Ser. No. 335,800; "Manufacturing Process for Channel Seal", Ser. No. 365,814, U.S. Pat. No. 4,392,897; and "Protective Strip for Z-Fold Bag Closures", Ser. No. 335,955, U.S. Pat. No. 4,410,130.

2. Brief Description of the Prior Art

Bags with various closure arrangements have been used to hold sandwiches, garbage, and for other household uses. These bags usually are comprised of a bag body and some type of closure arrangement. The most common closure arrangement for disposable bags like these has been a separate device like a "twister" which is applied to the bag by the user. Previous attempts at constructing bags with acceptable integral closure arrangements have included the so-called profile bags where the closure comprises one or more sets of mating channels. Each channel may be formed as an integral part of the bag or fabricated as a separate piece and attached to the bag. One example of a profile closure is found in Reissue Pat. No. 28,969 to Natito. Other examples of profile bags include U.S. Pat. No. 3,226,787 to Ausnit and U.S. Pat. No. 3,060,985. As seen in U.S. Pat. No. 4,186,786 to Kirkpatrick, colored channels have been used to allow the user to more easily detect complete occlusion of profile bag openings. In order to achieve satisfactory use of profile bag closures, however, the mating members must fit properly and be aligned correctly. It may take several attempts at closing the bag before proper registration of the mating members is finally achieved. Bags with profile closures also tend to be an expensive choice for uses which do not require the containment of liquids.

Other types of integral bag closures use one or more adhesive strips. Problems with such adhesive closures include weak shear strength because the exposed adhesive for a strip must be selected to be weak enough so that it does not undesirably stick to other bags while on a roll or in a box.

An attempt to combine a profile closure with an adhesive may be seen in U.S. Pat. No. 3,339,606 to Kugler. The releasable closure in the Kugler patent comprises a tongue on one member and a groove on the other member where the tongue is of a thickness less than the width of the groove and wherein a releasable pressure sensitive adhesive is provided to keep the tongue within the groove. This structure, however, still requires registration of mating channels. Attempts to protect the adhesive strip until the bag is used may be seen in U.S. Pat. No. 3,420,433 to Bostwick and U.S. Pat. No. 3,990,627 to Olson (and assigned to the same assignee as this application). It is difficult, however, to find an adhesive which is easy to apply, which is strong enough to form an effective seal upon closure, but which does not cause undesirable problems by sticking to other bags or miscellaneous surfaces.

Other types of closures, such as zippers and Velcro TM strips have, on occasion, been incorporated into reusable bags as closures. However, the costs of manufacturing and attaching these types of closures to film bag bodies virtually eliminates them as commercially viable candidates for use in disposable thin film plastic bags.

Thus, it is an object of the present invention to provide a bag having a nonadhesive closure. It is a further object of this invention to provide bags for use in a variety of applications in which the closure is not easily unsealed. It is yet another object of this invention to provide a bag having a closure seal wherein the closure seal does not have to be in exact registration to effect closure. It is a further object of this invention to provide a flexible bag with an openable and resealable closure. It is another object of this invention to provide a flexible bag with a resealable closure which exhibits good shear or peel strength. It is yet another object to provide a closure for disposable, thin film plastic bags which can be integrally formed into the bag. It is yet another object of the invention to provide an inexpensive integral closure for disposable, thin film plastic bags. These and other objects of the invention will be apparent from the following description.

SUMMARY OF THE INVENTION

The present invention provides a bag having a closure which is suitable for use in a variety of applications, including sandwich bags and garbage bags and particularly the larger trash type disposable bag. Especially preferred are those bags made from polyethylene or a similar type of plastic material. The closure comprises two substantially identical ripple strips either applied to the bag in preselected areas or formed in the bag as an integral part thereof. Each ripple strip comprises a band of plastic in which has been formed a plurality of sinusoidally shaped rows spaced so that the highest amplitude of one row is adjacent to the lowest amplitude of the nearest rows; thereby also creating a series of rows of nodes where the plastic material has not been substantially displaced and where the rows are connected together. At the place of maximum displacement in each row for the individual waves of one closure embodiment, small plastic flanges have been impressed on either side of the area of maximum displacement in one embodiment. In a second closure embodiment, regular variations in the transverse width of each row provide a preferred "locking" face having regions of maximum displacement with enlarged widths which overlap and interlock with like regions on a preferred "locking" face of a second opposing strip. In this embodiment, material is taken from the remaining regions of the strip to provide the enlarged widths of the "locking" face regions of maximum displacement. In a particular described embodiment of the second type of closure, the side edges of each row are sinusoidal with respect to the longitudinal axis of the row to provide the required variation in widths. Closure is effected by pressing one strip into the other strip.

In one bag embodiment, the ripple strips are positioned such that the flap of the bag folds over the bag opening. In a second bag embodiment, two ripple strips are positioned internally to the bag. A seal is similarly effected in other embodiments by pressing the two ripple strips into contact so that an interlock between flanges and waves or between the widened side edges is formed.

BRIEF DESCRIPTION OF THE DRAWINGS

25

DETAILED DESCRIPTION OF THE DRAWINGS

Figure 1:
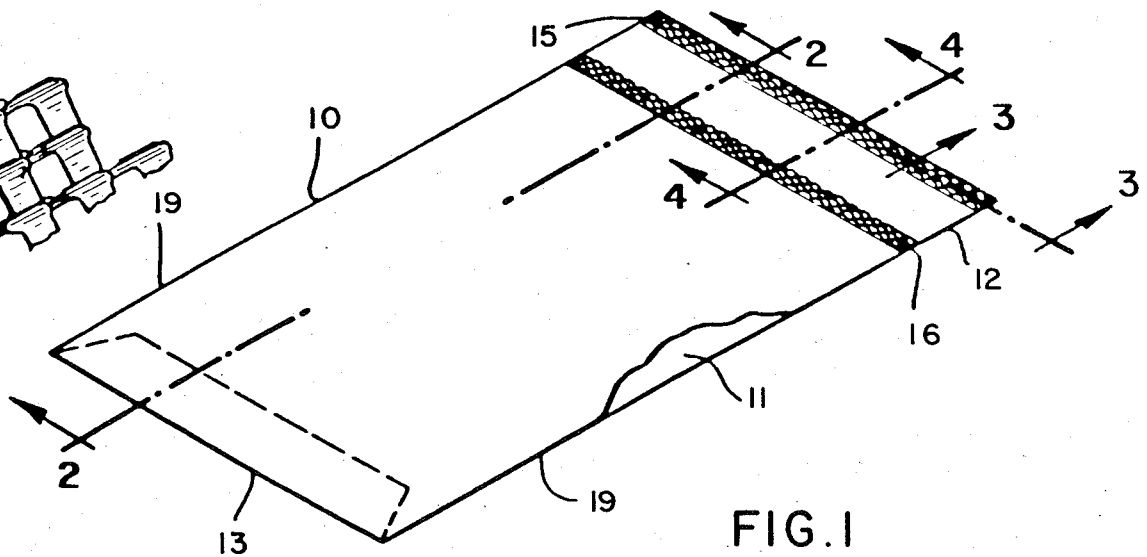
FIG. 1 is a view of a flat sandwich bag having a closure and constructed in accordance with this invention.
Figure 2:
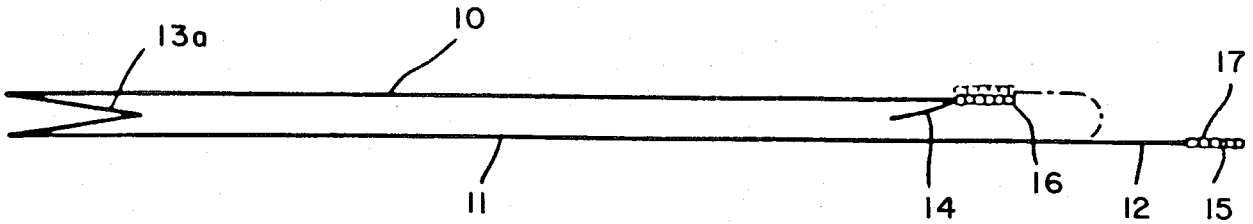
FIG. 2 is a cross-section of FIG. 1 taken along line 2—2.

FIGS. 1 and 2 show a sandwich bag constructed in accordance with this invention. A bag or bag body comprises a front wall 10 overlying a backwall 11 from which a flap portion 12 extends. Front wall 10 is attached to backwall 11 along longitudinal edges 19 and bottom 13, thereby forming an open mouth adjacent to the top edge of the front wall. The bag may be constructed with a gusset 13*a* and an interior fold of film for flap 14 to better accommodate the thickness of an object such as a sandwich. The bais preferably made out of plastic film such as polyethylene.

Figure 4:
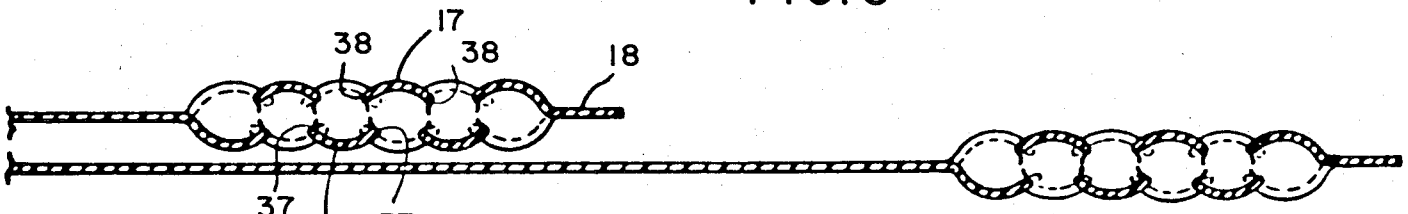
FIG. 4 is a sectional view of an enlarged cross-section of the closure in an open position taken along line 4—4.

Flap 12 has a ripple strip 15 positioned thereon at a preselected distance from the opening. This ripple strip 15 is comprised of a base 18 (as shown in FIG. 4) in which a plurality of sinusoidally shaped, parallel waves 17 of substantially uniform width have been formed. These waves are aligned in such a way that the area of maximum amplitude or upper displacement of one row is adjacent to the area of lowest amplitude or downward displacement of the next row(s). Strip 15 may be fabricated in a separate step and applied to the flap 12 or it may be formed as an integral part of flap 12, e.g. by embossing or by a heat deformation process. The strip is formed of a flexible resilient material, again preferably plastic such as high density polyethylene. Exemplary methods and apparatus for forming the strips are described in U.S. Pat. No. 4,123,826 incorporated herein by reference.

A second ripple strip 16 is positioned on the opposite side of the bag opening from ripple strip 15. Preferably both ripple strip 15 and ripple strip 16 should be continuous or uninterrupted. The ripple strip 16 is substantially congruent to strip 15 in terms of row width and sinusoidal wave pitch so that the waves of the two strips will nest together during closure. Sealing of the bag is effected by folding flap 12 over a substantially flat portion of front member 10 until the bag is positioned around an object contained therein. Ripple strip 15 is positioned in proximity to ripple strip 16 such that these strips will be in substantial contact when pressed together. Sealing is effected by exerting pressure such that the interlocking members of these strips fit together. It should be noted that since there are a plurality of rows of these waves, exact mating of all of the wave structures is not required.

Figure 1A:
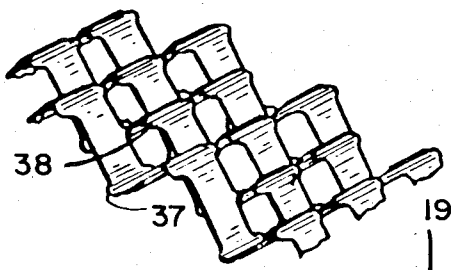
FIG. 1A depicts the closure of FIG. 1 an enlarged, perspective view.

FIG. 1A is a greatly expanded view of the ripple strips 15. As can be seen each row of the strip is symmetric with identical flanges 37 and 38 located on either side of each row at the points of maximum deflection.

Figure 3:
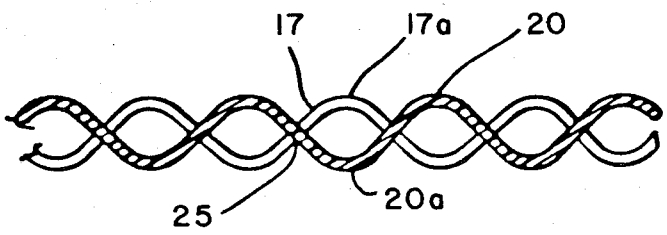
FIG. 3 is a partial cross-section of the ripple strip taken along line 3—3.

FIG. 3 shows a partial cross-section of a ripple strip in which one can see the position of adjacent waves as formed in the base. Wave 17 with maximum upward displacement at point 17*a* is positioned adjacent to sectioned wave with a maximum downward displacement at point 20*a*. The positioning of these adjacent waves forms a node 25 in which there is no substantial displacement and no severing or separation of the base strip. Flanges 37 and 38 are positioned at the points of maximum displacements (i.e. points 17*a* and 20*a*) on either side of the wave structure and extend outwardly therefrom.

FIG. 4 shows an enlarged transverse sectional view of the closure in FIG. 1 in an open position.

Figure 5:
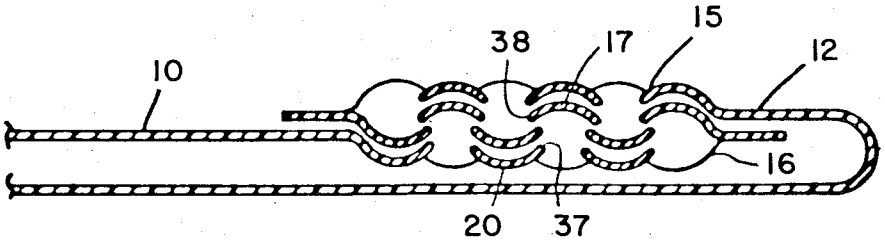
FIG. 5 is a sectional view of an enlarged cross-section of the closure in a closed or sealed position.

FIG. 5 shows an enlarged sectional view of the bag of this invention with a cross-section of the closure in a sealed position in which strip 15 and strip 16 have been formed as integral parts of the flap 12 and the front portion 10 of the bag, respectively. Closure has been effected by contacting strips 15 and 16 and pressing these strips together. Because they are resilient, the projections 37 and 38 on the sides of the proximally adjoining points of maximum deflection of the strips 15 and 16 are deflected so as to collapse until the projections 37 and 38 are able to pass one another. The projections 38 then deflect back to their original orientation overlapping one another as depicted in FIG. 5. Thus, the closure is mechanical as well as frictional. It is to be noted that exact alignment of these strips 15 and 16 is not needed for a seal, and that a seal will be effected if only portions of the strips are in contact or overlapped.

Figure 6:
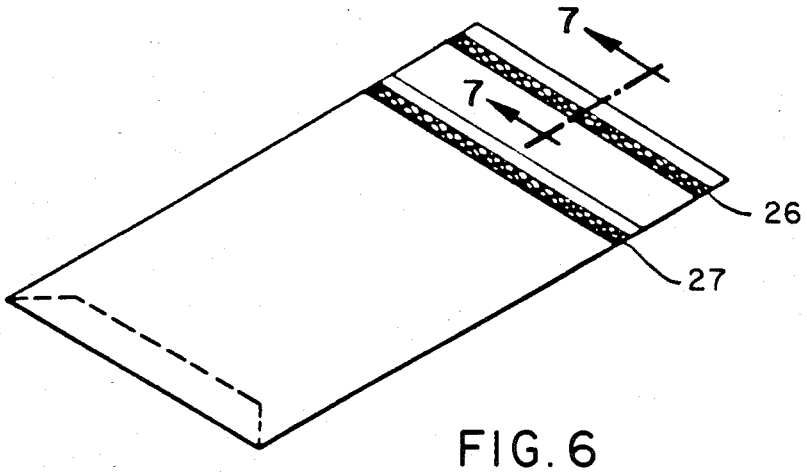
FIG. 6 is a view of an alternate embodiment of a sandwich bag constructed in accordance with this invention in which separate strips have been applied to the bag.
Figure 7:
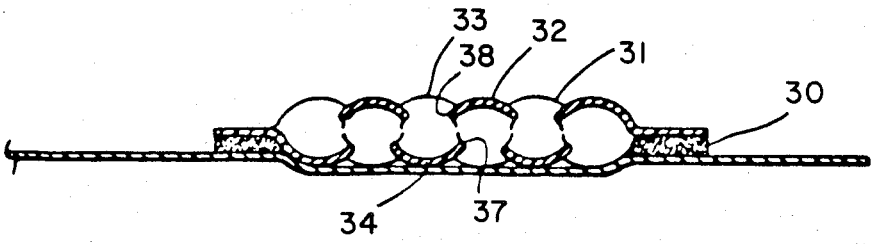
FIG. 7 is a cross-section of FIG. 6 taken along line 7—7.

FIGS. 6 and 7 show an alternate embodiment of the bag of this invention in which each ripple strip has been separately fabricated and applied to the bag as strips 26 and 27. Thus in FIG. 7 one sees a separately manufactured bag base 34 and one of the strips 26 or 27 with rows 31–33 next to each other adhered to the base 34 by adhesive layer. Each row is aligned such that the sectional area of maximum upward displacement of row 32 is adjacent to the sectional areas of maximum downward displacement of the adjoining rows 31 and 33.

Figure 8:
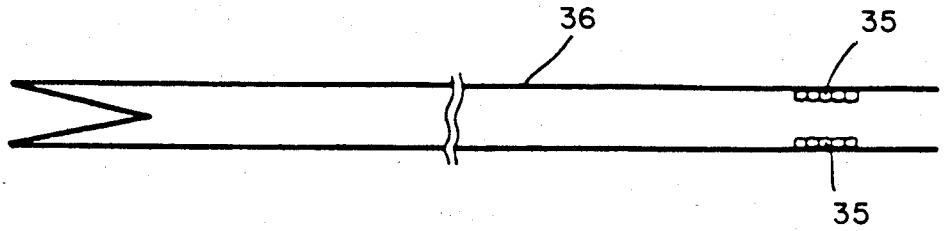
FIG. 8 is a view of a third embodiment constructed in accordance with this invention in which the ripple strips are located internally to the bag.

FIG. 8 shows a third embodiment of the bag of this invention in which the ripple strips 35 have been positioned internally to bag body 36.

Figure 11:
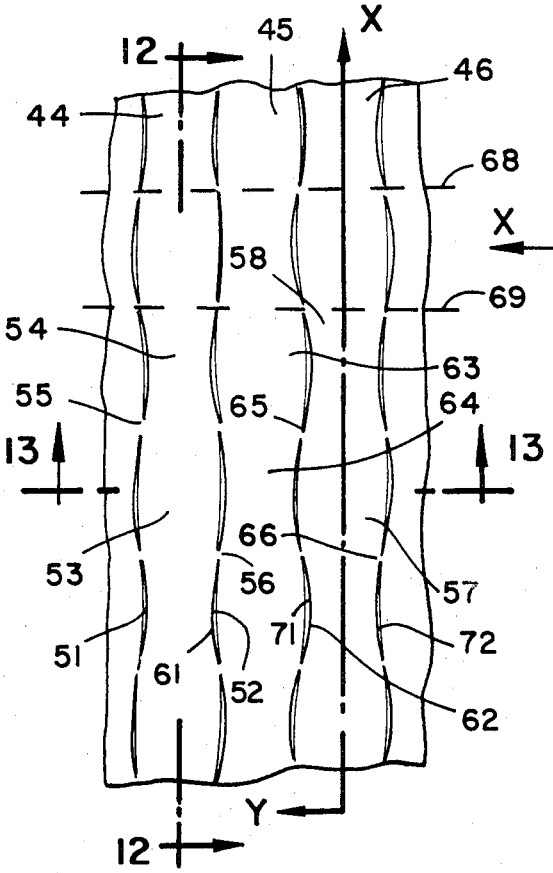
FIG. 11 is an enlarged plan view of a portion of three of the rows of FIG. 10 forming the ripple strip closure of FIG. 9.
Figure 12:
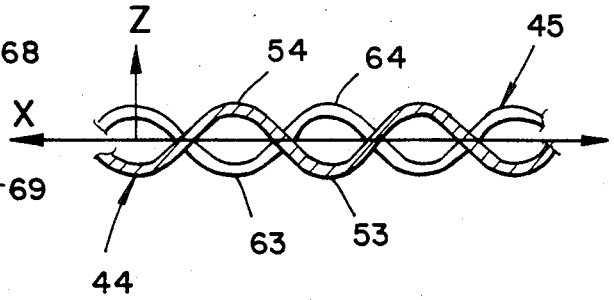
FIG. 12 is a side sectioned view of the enlarged rows of FIG. 10 along the lines 12—12.
Figure 10:
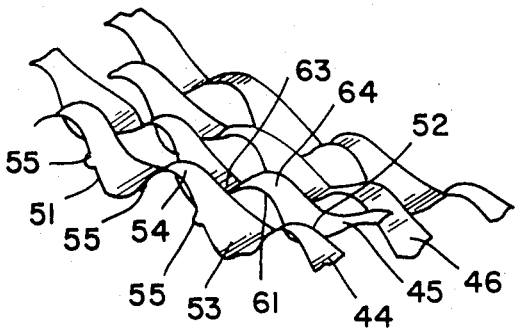
FIG. 10 depicts portions of four rows of FIG. 9, in an enlarged perspective view.
Figure 9:
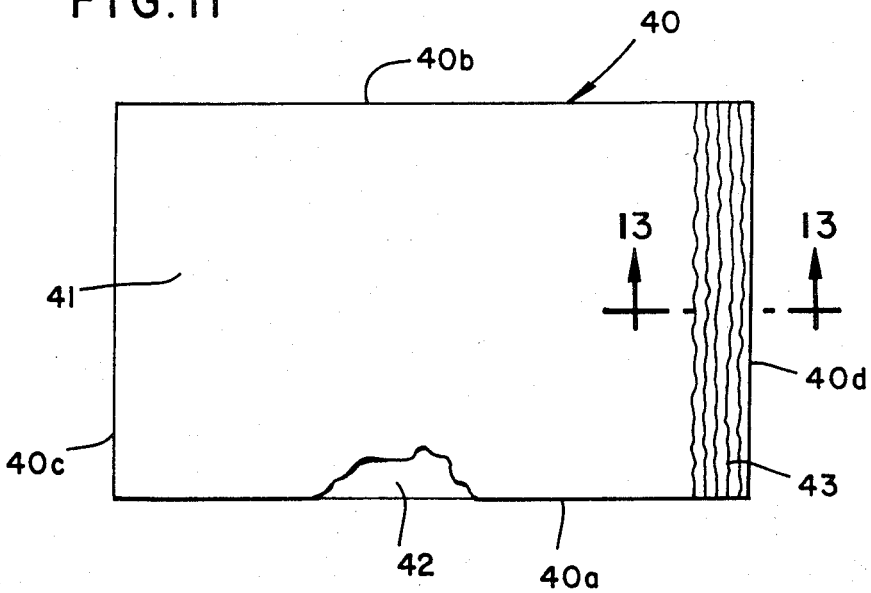
FIG. 9 depicts a thin film disposable plastic bag with an alternate embodiment, integral ripple strip closure.
Figure 13:
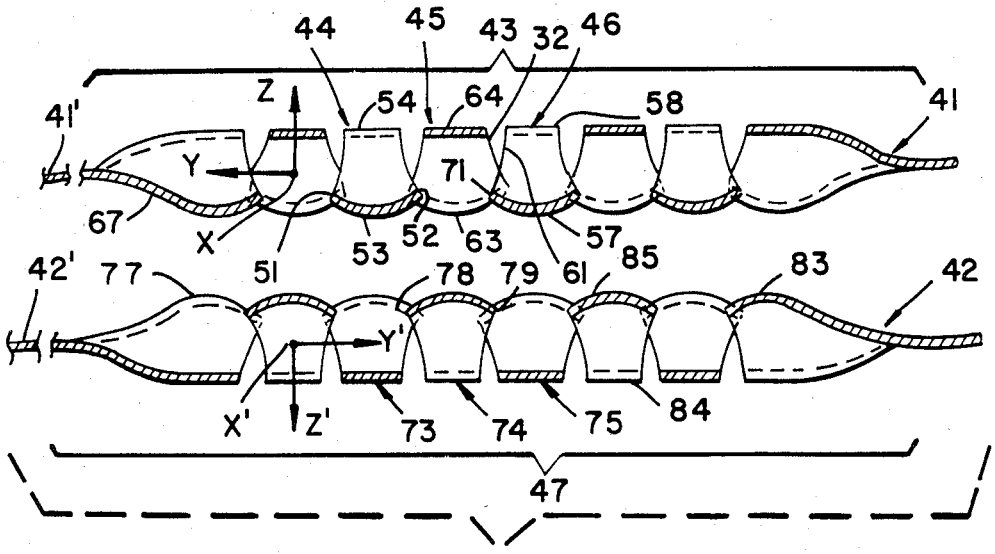
FIG. 13 is an enlarged transverse cross-sectional view of the bag closure of FIG. 9 along the lines 13—13 in a face to face orientation for closure of the bag mouth.
Figure 14:
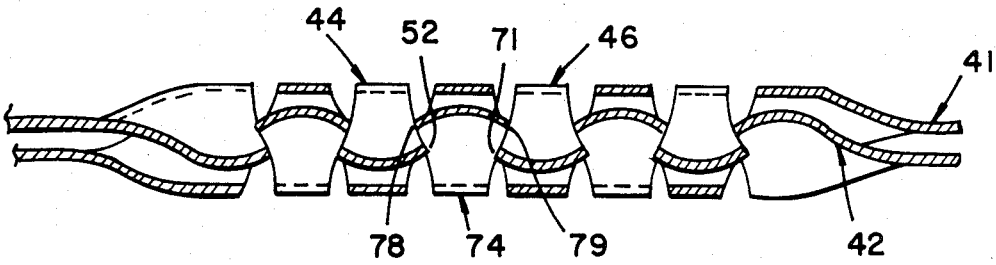
FIG. 14 is a transverse cross-sectional view of the ripple strips of FIG. 13 in the closed or locked position.

FIG. 9 depicts an envisioned plastic disposable garbage or trash bag embodiment 40 having upper and lower thin adjoining plastic walls 41 and 42 joined at three edges 40*a*, 40*b* and 40*c* and free at the fourth edge 40*d* forming a mouth of the bag. Wall 41 incorporates an asymmetric resilient ripple strip 43 with a plurality of parallel rows of waves, three of which 44–46 are partially depicted in FIGS. 10 and 11. Wall 42 includes a mirror ripple strip 47 seen, in part, in FIGS. 13 and 14, positioned so as to be in face to face orientation with strip 43 when the bag mouth is closed. Referring to FIGS. 11 and 12, the rows have parallel central longitudinal axes X. A cross-sectional view of row 44 and row 45 "behind" it is further depicted in FIG. 12. As is best seen in FIG. 12, each row undulates sinusoidally in a plane formed by its central longitudinal axis X and an orthogonal axis z towards and away from the associated wall 41 and, in this particular embodiment, in and out of the plane of the bag wall 41 about a central longitudinal axis X of the row. In this closure embodiment, the width (i.e. distance between the side edges) of each row also varies along the length of the row. In particular, as can be seen in FIG. 11, the side edges 51 and 52 of row 44, side edges 61 and 62 of row 45 and side edges 71 and 72 of row 46 are sinusoidal with respect to the central longitudinal axis X of each row and with respect to the plane formed by X and a third axis Y orthogonal to X and Z and lying with X in the plane of the bag. The side edges of all other rows are similarly sinusoidal. Also like row 46, each row is widest at its points of deepest inward deflection 53 into the bag and narrowest at its points 54 of maximum outward deflection from the bag. As was the case with the first closure embodiment of the previous figures and as is depicted in FIG. 12, the points of maximum inward deflection of a given row, such as point of maximum inward deflection 63 of the row 45, are located adjacent points of maximum outward deflection of adjoining rows, such as maximum deflection point 54 of the row 45 and point 58 of row 46 (see FIG. 11). By making the side edges of the rows sinusoidal in this fashion, material is taken from the outwardly deflecting alternate portions of each row (e.g. portions with outward deflection points 54 and 58) to widen the adjoining inwardly deflecting alternate portions of the adjoining rows (e.g. portion with inward deflection point 63 adjoining both 54 and 58). The adjoining pair of rows 45 and 44 are connected together at their adjoining side edges 52 and 61, respectively, by nodes 56 where each row intersects its central longitudinal axis X midway between its adjoining consecutive portions of maximum inward and outward deflection 53–54 and 63–64 respectively. Adjoining pairs of rows 45 and 46 are joined at nodes 65. Row 44 and its remaining adjoining row are joined by nodes 55 while row 46 and its remaining adjoining row are joined by nodes 66. The pitch (number of rows per unit width of the strip) and period (length between sequential inwardly deflecting or outwardly deflecting segments or portions) of the waves of the rows of the two strips are the same so that the rows of each strip nest with the rows of the opposing strip when joined. The nodes therefore appear at uniform intervals along the side edges of each row and also form parallel rows, indicated by broken lines 68 and 69 in FIG. 11, transverse to the central longitudinal axis X of the rows. The node rows 68 and 69 need not be perpendicular to the axis X of the wave rows 44–46. The successive nodes along the side edges of each row (i.e. nodes 55 and 56 along edges 51 and 61, respectively, of row 44) in effect divide the row into a series of consecutive adjoining portions, a first subset of alternate portions deflecting inwardly (i.e. towards opposing panel 42 and strip 47 as shown in FIGS. 13 and 14), as do the alternate portions of row 44 with points of maximum inward deflection 53, and a second subset of remaining alternate portions deflecting outwardly (i.e. from the opposing panel 42 and strip 47 as shown in FIGS. 13 and 14) as do remaining portions of row 44 with points of maximum outward deflection 54. Again and as is best seen in FIG 10, the alternate portions of each row deflecting inwardly (i.e. down for strip 43 in FIG. 10) alternate with like inwardly deflecting alternate portions of each of the two adjoining rows along the lengths of each pair of adjoining rows as do the alternate portions of rows 44 having maximum inward deflection points 53 with alternate portions of row 45 having maximum inward deflection points 63.

Figure 15:
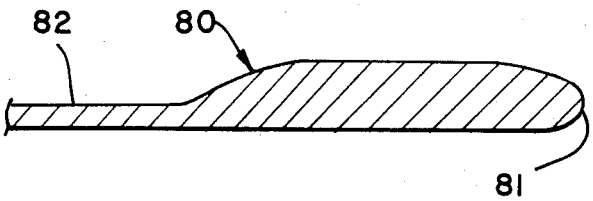
FIG. 15 depicts a cross-section of an extruded thin film sheet provided with a thickened edge with in which to form the closures of the subject invention.

FIG. 13 depicts the positioning of the ripple strip 43 and a mirror ripple strip 47 on wall 42 in a face to face orientation for closure. The side edges 51 and 52 and consecutive row segments with points of maximum inward and outward deflection 53 and 54 separated by the nodes 55 and 56 of the row 44 of FIGS. 10 and 11 are also depicted for reference. The ripple strips 43 and 47 are sectioned transversely to the central longitudinal axes of the rows at the point of maximum outward deflection 64 of row 45 and rows alternate with it and at the point of maximum inward deflection 53 and 57 of the rows 44 and 46 adjoining row 45 and rows alternate with 44 and 46. Like the strip 43, each wave now of the strip 47, three of which are numbered 73–75, is sinusoidal in a plane formed by its central longitudinal axis X′ and an orthogonal axis Z′ substantially normal to the plane of the wall 42. Each side edge of each wave row is also sinusoidal in the plane formed by its central longitudinal axis X′ and the orthogonal axis Y′ substantially in the plane of the wall 42. Like the rows of the ripple strip 43, the rows of the ripple strip 47 are widest at and about their points of maximum inward deflection 85 and narrowest at their points of maximum outward deflection 84 from the bag body. When squeezed together, the side edges of each of the inward deflecting portions of the rows of both strips distort the side edges of those portions of the rows of the opposing strip and deform and deflect one another sufficiently to allow passage of the points of maximum inward deflection past one another. Once past one another, the deflected and deformed portions of the rows return their original configuration with the edge of the maximum inward deflecting portions of the rows forming mechanical interlocks with one another as is depicted in FIG. 14. The thickness of each wall of the bag is greater where the ripple strips 43 and 47 are formed than elsewhere. The remaining thinner portion of the bag walls 41 and 42 are indicated diagrammatically by wall sections 41' and 42' respectively. It is further suggested that the maximum inwardly deflecting portions of each wave 43 and 47 be provided with a transverse convex shape facing the opposing ripple strip and the portions of maximum outward deflection be provided with transverse cross-sections that are straight like 54, 64, and 58 in FIG. 13 as indicated, or even convex outward from the bag body. The convex portions of maximum inward deflection of the strips 43 and 47 facing one another on the inner surfaces 67 and 77, respectively, of the two bag walls 41 and 42 are more easily deformed and allow easier closure of the two ripple strips than would other geometries. The facing inwardly deflection portions of the two strips 43 and 47 are sufficiently wide between their side edges so that the side edges of each inwardly deflecting portion overlap adjoining side edges of side by side adjoining deflected portions of the opposing strip when centered between the side by side deflected portions when placed in a face to face orientation for closure, as do side edges 78 and 79 along inwardly deflected portion 76 of row 74 of strip 47 with respect to adjoining side edges 52 and 71 of side by side adjoining deflecting portions 53 and 57 of rows 44 and 46, respectively, of opposing strip 43. Moreover, as long as a physical interlocking overlap is provided between the side edges of the maximum inward deflecting portions of the two ripple strips 43 and 47, as is depicted in FIG. 15, the forces required to separate these strips is much greater than the forces to require to interlock them thereby they provide additional user convenience and safety. It will be appreciated that the inwardly deflected portions of segments of each strip 43 and 47 (i.e. the segments with points of maximum inward deflection 53, 63 and 57 of strip 43 and 76 of strip 47) form one set of row segments which alternate with oppositely deflected segments along each row (like 54 and 53 of row 44 in FIGS. 10–12) and side-by-side in adjoining rows (like 63 between 54 and 58 of rows 44–46 in FIGS. 10 and 11). As is best seen in FIG. 11, the maximum width of each of the inwardly deflected segments (i.e. 53, 63 and 57) is greater than the maximum width of each of the remaining, outwardly deflected segments (i.e. 54, 64 and 58) while the minimum width of each of the latter set of segments is less than the minimum width of each of the former set of segments. Indeed the minimum widths of each of the former set of segments is less than the maximum widths of each of the latter set of segments. As is best seen in FIGS. 13 and 14, segments of the former set (i.e. greater width/inwardly deflected) of each strip are disposed closer to the opposing ripple strip than are the segments of the latter set (i.e. narrower width/outwardly deflected segments).

Figure 16:
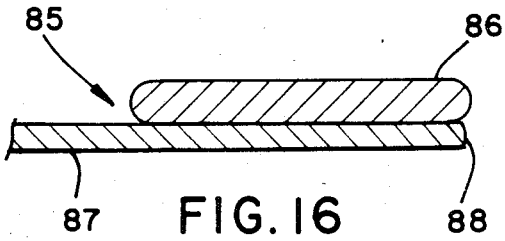
FIG. 16 depicts a cros-section of an exemplary laminate material providing a region of sufficient rigidity within which to form the closures of the invention.

Envisioned disposable plastic garbage and trash bags would have a capacity in excess of about 10 gallons and typically about 30 gallons or more, would be formed from a thin, polymer material, preferably polyethylene, with a maximum thickness of approximately 5 mils. or less typically about 3 mil, or less and perhaps as thin as 1 to 1.5 mils. outside e ripple strip region and a thickness of about 25 mils. or less and preferably only about 15 mils. in the region of the ripple strip. When the ripple strips are integrally formed in the bag walls, the needed differential thickness can be provided in the ripple strip region by increasing the thickness of the plastic material during extrusion in the manner described, for example, in U.S. Pat. No. 4,443,400, incorporated by reference herein in its entirety. The cross-section of a thin plastic film 80 prepared by that method is depicted diagrammatically in FIG. 15 and exhibits a greater thickness near edge 81 where the ripple lock strip would be formed by subsequent processing, than it exhibits in the remaining portion 82 of the sheet which would be used to form the remainder of the bag wall. Alternatively, a laminate material 85, such as is depicted diagrammatically in FIG. 16, may be formed by attaching a layer 86 of stiffer, more resilient material to a more pliant, thin film sheet 87 along an edge 88 of the sheet 87. The layers 86 and 87 may be laminated by conventional methods such as adhesives or heat welding. Polyethylene materials may be provided for the strip 86 and thin film sheet 87 in order that they may be heat welded by conventional hot rolling techniques. The sheet 87 may be either a low or high density polyethylene, depending upon the size and strength requirements of the bag, while the strip 86 is suggestedy a high density polyethylene, to provide relatively greater stiffness and resilience to the ripple strip. Although the ripple strips are preferably formed integrally in the bag wall, the strips may be formed separately and fastened to a bag wall as previously discussed with respect to FIG. 7.

Figure 17:
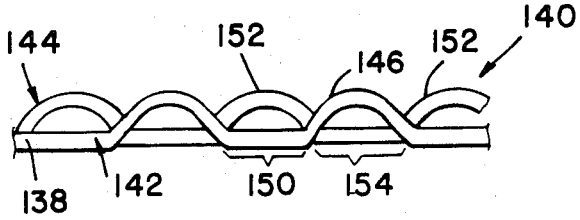
FIG. 17 is a side view of an alternate embodiment of the ripple strips of FIGS. 9–14.

FIG. 17 is a greatly enlarged side view of an alternate embodiment of the ripple strip closure of FIGS. 10–14. Ripple strip 140 of FIG. 17 is integrally formed in a bag wall 138 by a multiplicity of substantially parallel rows of waves, two of which, 142 and 144, are seen in this view. The remaining rows of strip 140 are hidden behind rows 142 and 144 in the figure. Each wave 142 and 144 is only semi-sinusoidal. Wave 142 comprises outwardly deflecting portions 146 alternating with undeflected portions 150 along the length of the wave. Wave 144 similarly comprises outwardly deflecting portions 152 alternating with undeflected portions 154. Like the previously described ripple strip embodiments, the outwardly deflecting portions of each row alternate with outwardly deflecting portions of immediately adjoining rows. Row 142 is joined to row 144 by connecting nodes (not seen in FIG. 18) located where the deflecting portion 146 of row 142 meet adjoining undeflected portions 150 of the row. A plan view of the rows of the ripple strip embodiment 140 looks like the plan view of rows 44–46 in FIG. 11. The outwardly deflecting portions 146 and 152 of each row 142 and 144 are wider than the undeflected portions 150 and 154, respectively of the row. The variation in width is again preferably provided by row side edges which are sinusoidal with regard to a central longitudinal axis of the wave. A closure is again provided by associating a mirror image ripple strip with another wall of a bag so that the deflecting portions of each strip may be brought to a face to face orientation and compressed so as to force the overlapping side edges of the deflected portions of the two strips past one another, whereby mechanical interlocks are formed by overlap of the side edges of the outwardly protruding portions of each strip.

Pluralities of these closures may also be used so that a bag may have to or more closure structures.

The bags of this invention have closures which afford protection of the contents of a bag and allow a stronger seal to be provided for such a bag. These bags are able to withstand substantial forces from within and exhibit superior peel strength. The closures greatly facilitate the closing of a bag of this invention because exact registration of opposing closure elements is not required as in much of the prior art.

Although specific embodiments of the present invention have been described, it is to be understood that modifications and variations may be found by those skilled in the art which are within the spirit and scope of the invention.

What is claimed is:

1. A disposable plastic bag comprising:

a pair of adjoining plastic planar walls each having one free edge and one or more remaining edges joined with like remaining edges of the other wall to form a bag body having a mouth at the free edge of each wall;

a resilient ripple strip associated with each wall and positioned with respect to the wall so as to be brought in a face to face orientation with a similar strip associated with the other wall when the the bag mouth is closed;

each ripple strip being formed by a multiplicity of parallel rows joined together along adjoining side edges of the rows at nodes spaced at regular intervals along the adjoining side edges, each alternate portion of each row between successive nodes on the side edges of the row being deflected towards the opposing strip in said face to face orientation, said deflected alternate portions of each row being alternated with said deflected alternate portions of each adjoining row along the lengths of each pair of adjoining rows and said deflected alternate portions of each row each having a minimum width between the side edges of the row greater than the maximum width of remaining portions of the row between the nodes so at side edges of said deflected alternate nortions of the two ripple strips overlap adjoining side edges of side by side adjoining ones of said deflected alternate portions of the opposing strip when centered between said side by side adjoining ones of said deflected alternate portions whereby a mechanical interlock is formed by the overlapping edges of said deflected alternate portions of the two strips when the two strips are placed in said face to face orientation and compressed together so as to force the overlapping side edges past one another.

2. The bag of claim 1 wherein the side edges of each row are sinusoidal and symmetric with respect to a central longitudinal axis of the row so that the width of each said row also varies sinusoidally along the length of the row.

3. The bag of claim 2 wherein said deflected portions have a convex surface facing the opposing strip when the two strips are positioned in said face to face orientation.

4. The bag of claim 3 wherein the remaining portions of the rows between the nodes are deflected away from the opposing strip when said strips are positioned in said face to face orientation.

5. The bag of claim 1 whein each ripple strip is integrally formed in the associated bag wall.

6. The bag of claim 5 wherein each wall is about 15 mils. or more thick where the ripple strip is formed and about 5 mils. or less elsewhere.

7. The bag of claim 6 wherein each wall is about 20 mils. or more thick where the ripple strip is formed and about 1.5 mils. or less thick elsewhere.

8. A disposable resealable plastic bag comprising:

a pair of planar walls each formed of plastic film and having one free edge and one or more remaining edges joined with like remaining edges of the other planar wall to form a bag body, the free edges of the air of walls defining a mouth of the bag body;

ripple strip means along each planar wall near said one free edge and positioned to be brought into face-to-face orientation with the ripple strip means of the other wall for closing the bag mouth, each of said ripple strip means being formed by a multiplicity of parallel, adjoining rows of resilient material, each pair of adjoining rows being joined together along adjoining side edges at nodes spaced at regular intervals along said adjoining side edges and separated from one another between said nodes, the nodes along the two sides edge of each row dividing the row into a series of segments between nodes, the segments of each ripple strip means being divided into two sets by width, the maximum width of each segment of one set being greater than the maximum width of each segment of the remaining set and the minimum width of each segment of the remaining set being less than the minimum width of each segment of the one set, the segments of the two sets being alternated with one another along each row and side-by-side in adjoining rows, and the segments of said one set of each ripple strip means being disposed closer to the other ripple strip means than segments of the remaining set of each ripple strip means when the two ripple strips means are brought into said face-to-face orientation, and segments of the one set of each strip means being adapted for passing between, overlapping and engaging segments of the one set of the other strip means when the two ripple strip means are pressed together in said face-to-face orientation.

9. The disposable, resealable plastic bag of claim 8 wherein said two ripple strip means are symmetric with respect to one another.

10. The disposable, resealable plastic bag of claim 8 wherein each of said rows is sinusoidal in width.

11. The disposable, resealable plastic bag of claim 8 wherein the segments of the two sets of each ripple strip are deflected in opposing directions to form rows of waves.

12. The disposable, resealable plastic bag of claim 11 wherein each of said rows is also sinusoidal in width.

* * * * *